United States Patent [19]

Lyons

[11] 4,135,508

[45] Jan. 23, 1979

[54] STAIRWAY STRINGERS

[76] Inventor: Robert J. Lyons, 1060 Ridge Rd., Hamden, Conn. 06514

[21] Appl. No.: 848,206

[22] Filed: Nov. 3, 1977

[51] Int. Cl.[2] ..... E06C 7/08; E06C 7/50; E06C 9/02

[52] U.S. Cl. ..... 182/194; 182/93; 182/219; 182/228

[58] Field of Search ..... 182/228, 194, 220, 215, 182/93, 217, 218, 219; 52/182, 188; 403/381, 354, 341

[56] References Cited

U.S. PATENT DOCUMENTS

| | | | |
|---|---|---|---|
| 2,003,876 | 6/1935 | Birtcher | 182/93 |
| 3,090,086 | 5/1963 | Fata | 403/381 |

*Primary Examiner*—Reinaldo P. Machado

*Attorney, Agent, or Firm*—St. Onge, Steward, Johnston, Reens & Noë

[57] ABSTRACT

A metal stairway stringer with horizontal slots at each tread level, into which the treads are inserted laterally for supporting them at one end, the other ends of the treads being similarly supported in like manner by a second stringer. The slots for the treads each taper from adjacent the open end at the edge of the stringer toward the back, so that the treads must be wedged into position and are therefore held rigidly by the stringer.

4 Claims, 4 Drawing Figures

STAIRWAY STRINGERS

BACKGROUND OF THE INVENTION

The present invention relates to stairway constructions and it relates more particularly to stairway stringers having slots for receiving and supporting the stair treads.

It is known to use pre-formed metal stringers of various types for receiving and supporting wooden stair treads, in order to facilitate on-site construction of a stairway in a building. In most instances the stringers are designed simply to support the treads, and separate fastening means such as nails are relied upon to retain the treads in place or to prevent rocking of the treads relative to the stringers.

It is the object of the present invention to more effectively secure the treads on and to prevent any wobbling or rocking of the treads in the stringers, without increasing the cost of the stringer or the work involved in installing the treads.

SUMMARY OF THE INVENTION

The invention resides in providing paired pre-formed stringers having slots in confronting faces which slots are disposed horizontally in the installed position of the stringers. The slots are open at their forward ends adjacent the front edge of the stringer, but are closed at their rear ends adjacent the rear edge of the stringers. Furthermore the slots are tapered from front to rear so that they are wide enough at their front ends to readily receive a wooden tread of standard thickness, but narrow down toward the rear to something slightly less than the thickness of the tread adjacent their closed ends. Consequently, in assembling the stairs, each tread is placed in the open end of each slot, but must be forced to the closed end of the slot due to the taper of the slot. In this way the tread becomes wedged in the slot so that it can not rock.

DETAILED DESCRIPTION OF THE PREFERRED EMBODIMENT

In the accompanying drawings.

Figure 2:
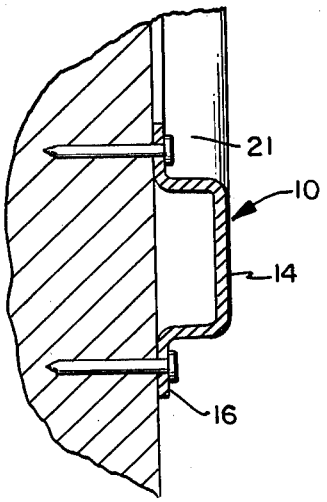
FIG. 2 is a cross section of the stringer on the line 2—2 of FIG. 1.
Figure 1:
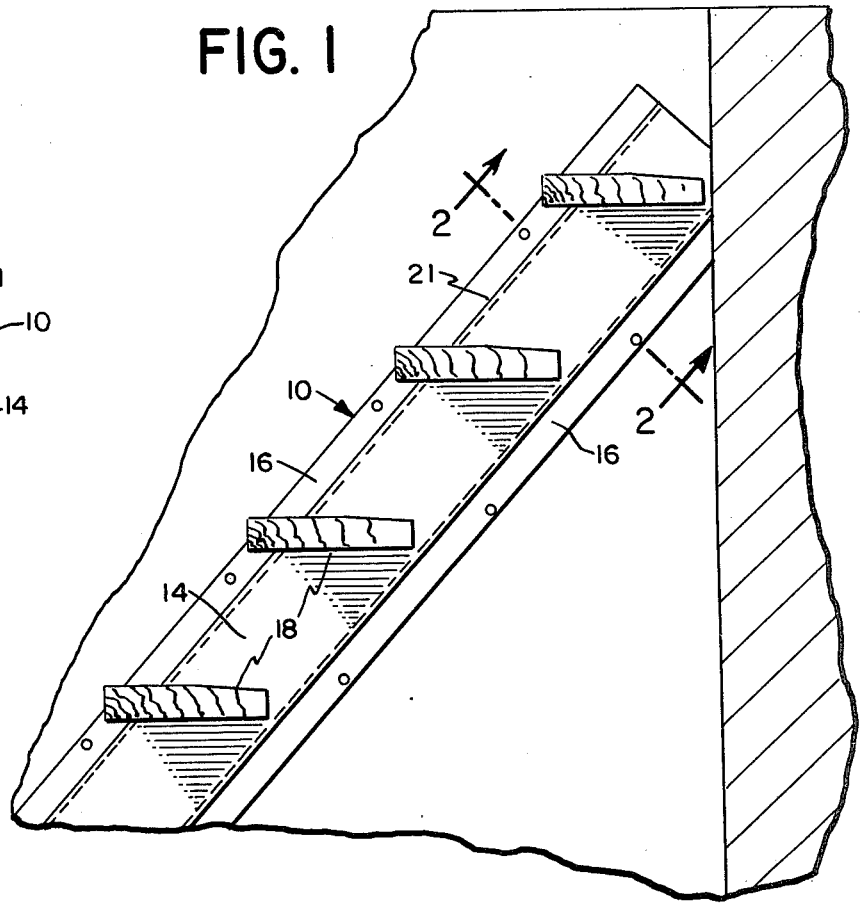
FIG. 1 is a vertical sectional view of the upper part of a stairway embodying the invention, the section being taken through the steps immediately adjacent the inner face of one of the stringers.
Figure 3:
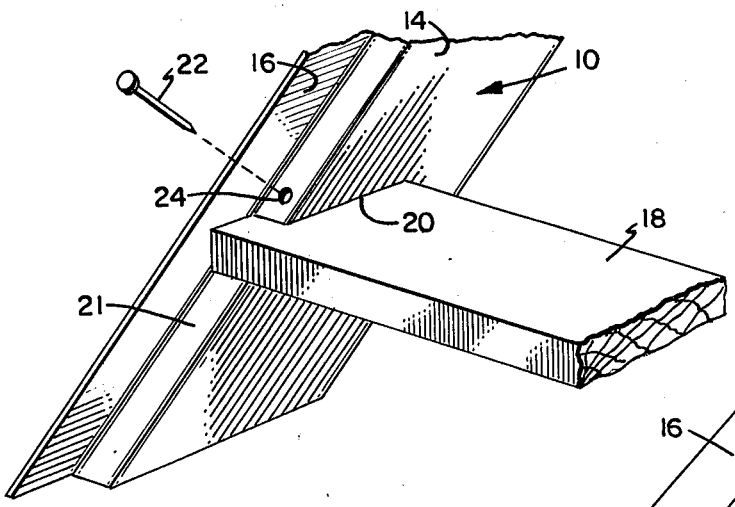
FIG. 3 is a perspective view of a portion of one side of the stairway.

Referring to the drawings two metal stringers 10 are mounted in spaced relation to each other in an outside stairwell for a basement. Stringers 10 (only one of which is shown in the drawings) may be mounted directly on the concrete side walls of the stairwell by means of suitable masonry anchors as shown in FIG. 2.

Stringers 10 are each provided with a raised central portion 14 and mounting flanges 16, 16 extending the full length of the stringer. The flanges 16, 16 mount flush against the side wall of the stairwell with the central portion 14 projecting inwardly toward the opposite stringer. Basement stairways usually have seven or eight treads 18, each of which is held at its ends in horizontal slots 20 in the central portion 14 of each stringer. Each slot 20 opens forwardly at the upwardly inclined edge 21 of the central portion 14 of the stringer, and extends rearward across the stringer at a predetermined angle, so that it is horizontal when the stringer is in place. The back ends of slots 20 are closed for positioning the treads in that direction.

Each tread 18, which may be a standard 2"×10" wood plank, is inserted edgewise into the open ends of the appropriate slots 20 in the two stringers 10 and moved rearward until its back edge rests against the closed ends of the slots, where it is secured in place by driving spikes 22 into it through holes 24 in both stringers.

Proposal has been made to employ slots which are uniform in their vertical dimension from front to back, this dimension being approximately the same as the thickness of the plank 18, so that the plank can be inserted into it. However, due to variations in thickness of planks, as well as to shrinkage and wear of the planks during use, the planks can become loose within the slots, so that they rock slightly when a person steps on them. This would not only be annoying, but would also give the person a feeling of instability when he walks up or down the stairs.

The present invention therefore involves tapering the slots 20 inward toward their closed ends, so that the plank 18 must be driven rearward against the end of each slot, thereby deforming the plank between the upper and lower edges of the slot, and effectively preventing the treads 18 from loosening in the stringers once they have been locked in the slots by the spikes 22. It should be noted that spikes 22 are driven into planks 18 at an angle toward the rear of each tread, thereby urging the plank toward the tapered end of each slot 20.

Figure 4:
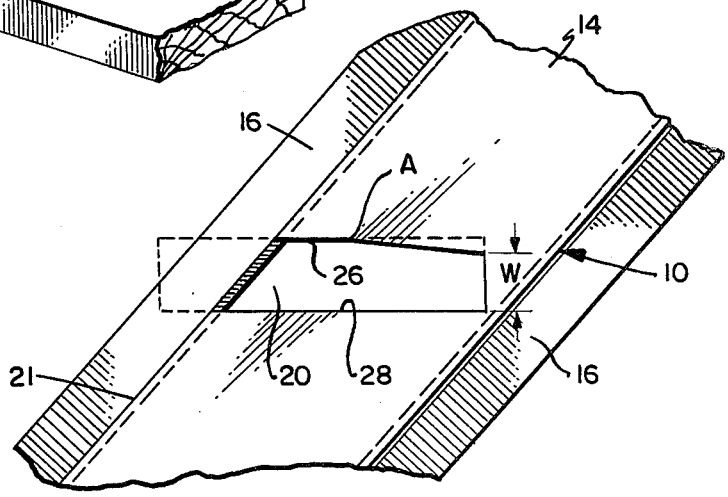
FIG. 4 is an enlarged side elevational view of a portion of the stringer showing the shape of one of the tread slots with the tread indicated in phantom.

As illustrated in FIG. 4, the vertical dimension of each slot 20 at its open end is approximately equal to the thickness of the tread 18. However, the upper edge 26 of the slot is tapered downward, beginning at the point A located a short distance in back of its open end. The degree of taper is relatively gradual, but is sufficient to ensure that the vertical dimension W at the closed end of the slot is less than the thickness of the tread. Thus, for nominal 2" planks which are usually used as treads for cellar stairs, the vertical dimension of each slot 20 should be 1⅝" at the open end and 1½" at the closed end, with the point A where the taper begins located about 1½" from the point at which the edge 26 intersects the upper edge 21 of the stringer 10.

In this instance, the lower edge 28 of each slot 20 is straight and is disposed to the edge 21 of the stringer at an angle which is the complement of the angle at which the stringer is inclined to the vertical, so that the lower edge 28 is horizontal when the stringer is installed. If desired, however, the upper edge can be made horizontal throughout and the lower edge inclined upward, or both the upper and lower edges can be inclined toward each other at substantially the same angle to the horizontal.

From the foregoing, it will be seen that an extremely simple, but effective means is provided for preventing loosening of stair treads in metal stringers.

What is claimed is:

1. In a stairway stringer comprising an elongate metal member for disposition on an incline having a plurality of slots therein, each of which extends transversely of said stringer in a horizontal direction when said stringer is disposed in its inclined position, each slot being closed at one end and open at one edge of said stringer to receive a wood tread member and having upper and lower edges spaced from each other at the open end of the slot by a dimension at least equal to the thickness of said tread member, the improvement wherein said upper and lower edges of said slot are inclined toward each other over at least a portion of their length so that the vertical dimension of the slot at its closed end is less than the thickness of said tread member whereby said tread member is wedged deformed between the edges of said slot as it is driven to the closed end thereof.

2. The improvement in a metal stairway stringer as defined in claim 1, wherein one of said upper and lower edges of said slot is horizontal throughout, the other of said slot edges being inclined to said one slot edge along at least a portion of its extent.

3. The improvement in a metal stairway stringer as defined in claim 1, wherein the lower edge of said slot is horizontal throughout, said upper edge being parallel to said lower edge for a short distance at the open end of said slot and inclined toward said lower edge for the balance of its extent to the closed end of said slot.

4. In a stairway construction comprising a pair of metal stringers spaced from each other and disposed on an incline, each of said stringers having a plurality of slots which extend transversely thereof, in a horizontal direction when said stringer is disposed in its inclined position, each slot being closed at one end and open at one edge of said stringer to receive a wood tread member or plank, the upper and lower edges of each of said slots being spaced from each other at its open end by a dimension at least equal to the thickness of said plank, the improvement wherein said lower edge of each of said slots is horizontal throughout its length, said upper edge being parallel to said lower edge for a short distance at the open end of the slot and inclined toward the lower edge for the balance of its extent to the closed end such that the spacing of said upper and lower edges at the closed end of the slot is less than the thickness of said plank, whereby said plank is deformed between the edges of said slot when it is driven to the closed end thereof, and a spike driven through said one edge of said stringer into said plank at an angle thereto such that said spike extends toward the closed end of said slot thereby urging said plank toward the tapered end of said slot in order to permanently lock said plank rigidly in said slot.

* * * * *

UNITED STATES PATENT AND TRADEMARK OFFICE

CERTIFICATE OF CORRECTION

PATENT NO. : 4,135,508

DATED : January 23, 1979

INVENTOR(S) : Robert J. Lyons

It is certified that error appears in the above-identified patent and that said Letters Patent are hereby corrected as shown below:

Column 3, line 9, after "member is", delete "wedged".

Signed and Sealed this

*Eighth* Day of *May 1979*

[SEAL]

*Attest:*

RUTH C. MASON
*Attesting Officer*

DONALD W. BANNER
*Commissioner of Patents and Trademarks*